United States Patent [19]

Noordermeer et al.

[11] 4,149,251

[45] Apr. 10, 1979

[54] DREDGE PROFILE COMPUTER FOR A CUTTER SUCTION DREDGE

[75] Inventors: Cornelis J. Noordermeer, Zwijndrecht; Johannes Maas, Rotterdam, both of Netherlands

[73] Assignee: Observator B.V., Hoogvliet, Netherlands

[21] Appl. No.: 777,733

[22] Filed: Mar. 15, 1977

[51] Int. Cl.[2] ..... G06G 7/66; E02F 3/18

[52] U.S. Cl. ..... 364/424; 37/67; 37/DIG. 1; 364/474; 364/807

[58] Field of Search ..... 37/67, DIG. 1, DIG. 20; 235/150.2, 151.3, 184; 364/424, 474, 807

[56] References Cited

U.S. PATENT DOCUMENTS

| | | | |
|---|---|---|---|
| 3,079,080 | 2/1963 | Mason | 235/150.2 |
| 3,934,126 | 1/1976 | Zalesov et al. | 364/424 |
| 4,035,621 | 7/1977 | Kemp | 364/424 |

*Primary Examiner*—Felix D. Gruber

*Attorney, Agent, or Firm*—Ladas, Parry, Von Gehr, Goldsmith & Deschamps

[57] ABSTRACT

A dredge profile computer for a cutter suction dredge converting the measured swing angle into the width of the cut in feet and the measured cutter-ladder angle to the depth of the cut in feet, being provided with an indicating unit to show the position of the cutter head with respect to a planar profile, and with a signalling unit to indicate the position of the cutter head by means of signalling lamps with respect to the centerline and with respect to the end of cut SB and PS, and with an adjustment and control unit presetting of warning and correction facilities.

6 Claims, 5 Drawing Figures

DREDGE PROFILE COMPUTER FOR A CUTTER SUCTION DREDGE

This invention relates to dredge profile computers and more particularly to analog data processing and commanding computers.

Nowadays when cutting channels, a greater accuracy in the determination of width and depth than was previously acceptable is demanded. On the one hand such a greater accuracy is required for saving costs with respect to removing too much material and reducing wear of the cutter heads specifically when cutting rocky areas, and on the other hand to satisfy the conditions set for the task.

According to this invention there is provided an analog data processing system, in which the data essential for the determination of the cutter position are supplied out of external signal transmitters. By means of adjustment knobs, most of them situated on the operating panel, the desired channel width, depth and slope-ratio can be fed into the computer. As soon as the tangent of the cutter approaches the adjusted width, PS or SB, the computer gives a warning signal. Before this signal, however, a pre-warning will be on. This pre-warning turns on at a number of feet, also pre-set on the operating panel, before the end of cut. The pre-warning is meant to switch the anchor-winches to half the speed, and the end warning is meant to switch them of. It is further possible to have the anchor-winches operated automatically, since the contacts of the relays, excited by the warning signals, are available at terminals at the rear-side of the computer.

An object of the invention is to provide for corrections of the cutter-depth in connection with the tidal difference as well as the trunnion depth, which corrections can be made by means of adjustment knobs on the operating panel, or automatically by means of suitable transmitters available.

Still a further object of the invention is to provide a computer embodied in the form of integrated circuits so, that the size of the computer can be reduced.

These and other objects of the invention will become more apparent to those skilled in the art by reference to the following detailed description when viewed in light of the accompanying drawings, wherein.

The invention will be described with reference to a dredge profile computer, which is designed for more efficient operations with cutter suction dredges. This computer converts the measured swing angle into feet width, and the measured cutter-ladder angle into feet depth. The computer is provided with a signalling unit permitting pre-setting of predetermined widths, so that for these widths warnings for end-of-cut and prewarnings for same are given. The relay-contacts associated with the signalling units are used for controlling the cutter's side winches.

The computer comprises furthermore a slope-unit which makes it possible to dredge slopes with various inclinations.

A typical cutter suction dredger consists of a floating pontoon, a cutter-ladder with a rotating cutterhead, and two spuds, one of which is mounted on a spudcarrier and forms the working spud. Such a cutter-suction dredger is in particular known from the U.S. Pat. No. 3,094,795 in the name of Ellicot Machine Corporation and entitled Electro-hydraulic dredge.

Figure 1:
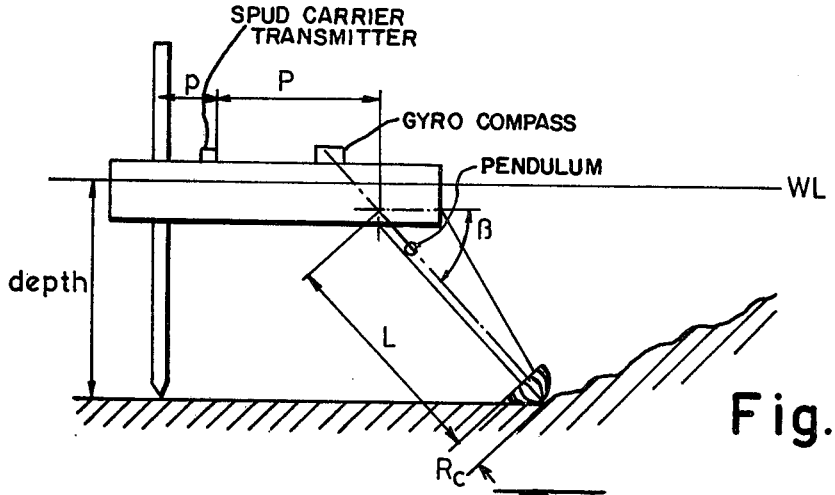
FIG. 1 is a schematic side elevational view of a cutting suction dredge, which for simplicity's sake is provided with only one spud.
Figure 2:
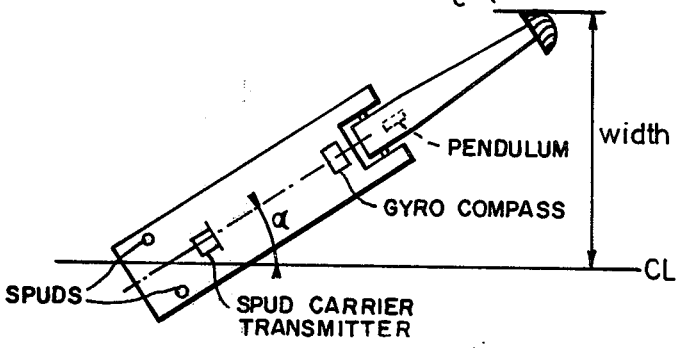
FIG. 2 is a plan view of FIG. 1.

The dredge profile computer according to the invention is an apparatus which computes the position of the cutterhead below water. As is shown in the FIGS. 1 and 2 this position is computed with respect to the waterline WL and the centreline CL of the channel: DEPTH and WIDTH.

The computation of the cutterhead coordinates is done by the following formulae:

$$\text{DEPTH}=L\cdot\sin\beta+R_c+T_1+T_2 \quad (1)$$

$$\text{WIDTH}=(P+p+L\cdot\cos\beta)\sin\alpha+R_c \quad (2)$$

in which $\alpha$=swing angle $\beta$=ladder angle

L =ladder length (distance of ladder trunnion to centre of cutterhead).

P =pontoonlength (distance of ladder trunnion to spud, spud in most forward position)

p =spud carrier position $R_c$=radius of cutterhead $T_1$=trunnion depth correction $T_2$=tidal difference correction.

Some of these data have fixed values such as the ladder length, pontoon length and the cutter radius. These values are pre-set inside the apparatus. The other data may all vary; even trunnion depth changes with varying ladder angles, because the pontoon's centre of gravity may be shifted.

As a standard the tide and trunnion depth corrections are manually adjusted on the front panel of the apparatus to obtain in such a way a dredging depth indication with respect to a reference water level. However it is also possible to use automatic transmitters for these purposes.

Figure 3:
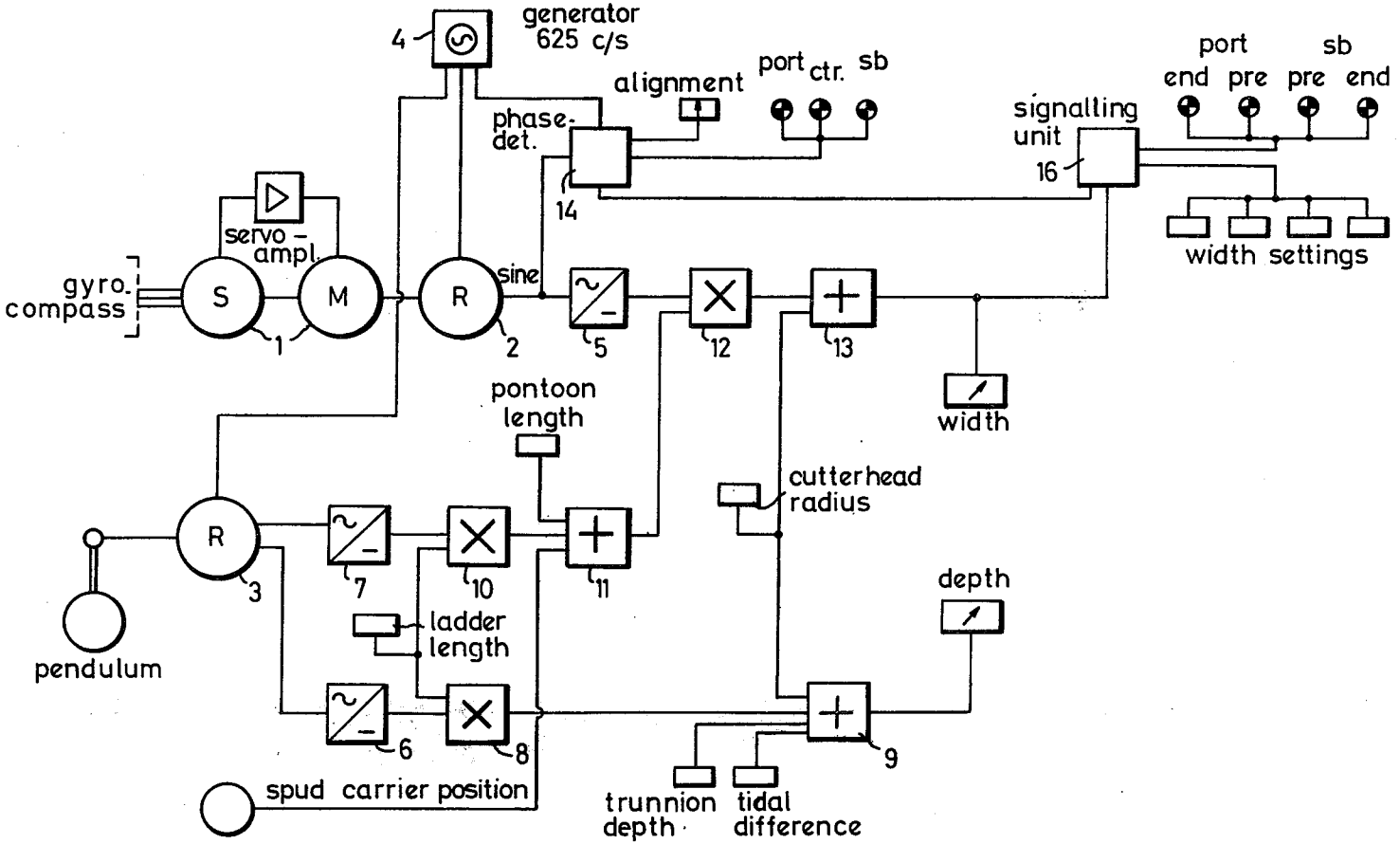
FIG. 3 is a main circuit diagram of the computer in accordance with a form of the invention.

The main circuit diagram of the computer is shown in FIG. 3. It consists of a repeater system 1 with a servo motor M, which is synchro-linked by means of a servo-amplifier and a synchro with the sensitive element of a gyro-compass mounted on the pontoon. A resolver 2 is friction-coupled to the repeater and forms the terminal component for the first input of the computer.

A second input to the computer is formed by a pendulum mass, which is mounted on the cutter ladder to measure the ladder angle and which is furthermore mechanically connected to a second resolver 3, which is the terminal component of the second input to the computer.

The excitation windings of the resolvers are powered by a triangular AC voltage of 625 c/s, supplied by a generator 4. The triangular shape of the AC voltages helps to ensure a higher accuracy of the computer. The resolver output voltages are rectified by means of the rectifiers 5, 6 and 7 and conditioned such, that 0 to 10 Volt ≙ sin 0° to sin 90°

10 to 0 Volt ≙ cos 0° to cos 90°.

The output of the rectifier 6 is equal to the sine of the ladder angle and is connected with the first input of a multiplier 8 having as a second input a signal representing the ladder length. This signal is internally pre-set by means of a multiturnpotentiometer with a digital drive. Throughout the whole computer the signal ratio used is 100 milliVolt ≙ 3 feet.

The output of the multiplier 8 is connected to one of the inputs of an adder 9 having as other inputs the cutterhead radius, the correction for the trunnion depth and the correction for the tidal difference.

After the rectifier 7 a second multiplier 10 is arranged having as a second input also the ladder length. The output of the multiplier 10 is connected to an adder 11 having as other inputs the pontoon length and the spud carrier position supplied by a spud carrier position transmitter. The resulting output signal is fed to the second input of a multiplier 12 having its first input connected to the output of the rectifier 5. The output of the multiplier 12 is connected to a first input of an adder 13 having as a second input the cutterhead radius.

A phase detector 14 is also connected to the output of the resolver 2 and this detector has as a reference input an output signal of the generator 4 of 625 c/s. The output of the phase detector 14 is fed to an alignment indicator and to port, center and starboard indicating lamps. Another output of the phase detector 14 is connected with a signalling unit 16.

The output of the adder 13 is connected to a width indicator and to a second input of the signalling unit 16.

The output of the adder 9 is connected to a depth indicator. The signalling unit 16 has further inputs for width setting and outputs for pre-warning and end-of-cut lamps for port and starboard, which may be associated with relays for similar purposes.

The operation of the computer is as follows. In the repeater system 1 the course data are received, which are converted in the resolver 2 in such a way, that its output is proportional to the sine of the swingangle $\alpha$ of the pontoon. The pendulum measures the ladder angle $\beta$ with respect to the horizontal axis, which is converted in the resolver 3 to the cos. and the sine of that angle, so that the output of the rectifier 7 represents cos $\beta$ and the output of the rectifier 6 represents sin $\beta$. These outputs are multiplied with the ladder length by means of the multipliers 10 and 8 giving as result $L \cdot \cos \cdot \beta$ and $L \cdot \sin \beta$. In the adder 11 the pontoon length P and the spud carrier position p are combined with the output L sin $\beta$ of the multiplier 10, giving as a result the factor $(P+p+L \cdot \cos \cdot \beta)$ of formula (2). The output of the resolver 2 is rectified in the rectifier 5 and fed to the multiplier 12 in which it is multiplied with the result of the adder 11, and the output of the multiplier 12 is then equal to $(P+p+L \cdot \cos \cdot \beta) \sin \cdot \alpha$. To this expression the cutterhead radius Rc is added in the adder 13, so that the output of this adder 13 represents the width expressed in formula (2).

In a similar way the output of multiplier 8 represents $L \cdot \sin \beta$, to which in the adder 9 the cutterhead radius $R_c$, the correction for the trunnion depth $T_1$ and the correction for the tidal difference $T_2$ are added resulting in the depth, that is formula (1) as the output of the adder 9.

This result is the distance or the width between the centreline of the dredging job and the outside of the cutterhead.

The result for the obtained depth is the distance between the reference water level and the lower side of the cutter head.

Figure 4:
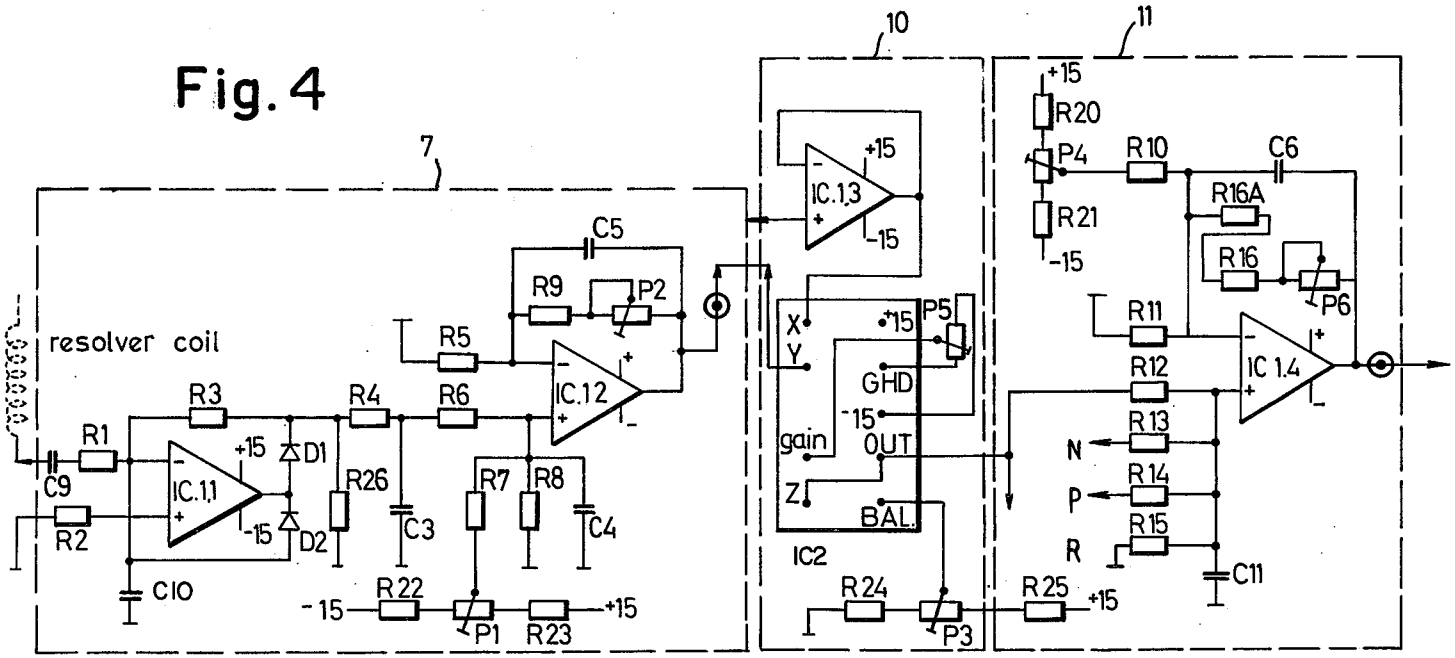
FIG. 4 is a detailed circuit diagram of a cosine converter to compute the horizontal distance between the working spud and the centre of the cutter head.

A more detailed circuit diagram of the rectifier 7, the multiplier 10 and the adder 11 is shown in FIG. 4. The rectifier 7 consists of two operational amplifiers IC 1.1 and IC 1.2. The integrated circuit 1.1 has its non-inverting input connected to ground via the resistor R2 and has its inverting input connected to one of the resolver coils of the resolver 3 via the resistor R1 and the capacitor C9. This inverting input is further connected to ground via the capacitor C10 and to the output of the IC 1.1 via a diode D2 having its cathode connected with the output. This output is also connected to the inverting input by means of a feed-back circuit consisting of the diode D1 and the resistor R3, the anode of this diode being connected to the output of IC 1.1. The output of this rectifying network is the junction of D1 and R3, which is connected to the non-inverting input of the second operational amplifier IC 1.2 via a matching resistor R26 and a smoothing circuit formed by the resistors R4 and R6 and the capacitor C3. The bias for the non-inverting input consists of the parallel circuit of the resistor R8 and the capacitor C4, which are connected to ground, and the resistor R7 connected to the wiper of a potentiometer P1, which is connected in a series circuit with the resistors R22 and R23, to which at each terminal voltages of plus 15 and minus 15 Volts respectively are applied. The inverting input of IC 1.2 is connected to ground via the resistor R5 and furthermore to the output via a feedback loop consisting of a parallel circuit of the resistor R9, the potentiometer P2 and the capacitor C5.

The multiplier 10 consists of a proper multiplying integrated circuit IC. 2 and a voltage follower IC 1.3. The non-inverting input of the operational amplifier IC 1.3 is connected to a presetting means for the ladder length and the inverting input of the amplifier is short-circuited with the output and connected to the first input of the multiplying circuit IC 2. The other input of the multiplying circuit is connected to the output of the operational amplifier IC 1.2. The multiplying circuit is furthermore connected to a potentiometer P3, which is connected in a series circuit with R24 and R25 to which a voltage of plus 15 Volts is applied and serves for a balance setting, and to a potentiometer P5 serving as a gain or span setting.

The output of the multiplying circuit IC 2 is connected to the non-inverting input of the operational amplifier IC 1.4 via a resistor R12, which amplifier is the functional component of the adder 11. This non-inverting input is further connected to ground via the capacitor C11 and the resistor R15, and to a presetting means for the pontoon length P via the resistor R13 and for the spud carrier position p via the resistor R14. The inverting input of the operational amplifier IC 1.4 is connected to ground via the resistor R11 and to a bias circuit via the resistor R10, which bias circuit consists of the resistors R20 and R21 and the potentiometer P4, and which circuit is connected between plus 15 Volts and minus 15 Volts. The output of the operational amplifier IC 1.4 is connected to the inverting input via a feedback loop consisting of a parallel circuit of the capacitor C6 and the resistors R16A and R16 and the potentiometer P6.

The circuit of the FIG. 4 operates as follows. The circuit is designed to compute the factor $$P+L\cos\beta$$

which represents the horizontal distance between the working spud and the centre of the cutterhead, and in which P and L have fixed values, which are set inside the computer. The distance p is a variable, given by the spud carrier position transmitter. As already mentioned before, the ladder angle $\beta$ is sensed by the ladder pendulum. Its cosine winding delivers an AC voltage with an amplitude proportional to the cosine of the ladder angle. This signal is fed to the half wave rectifier IC 1.1, in which capacitor C9 blocks any DC voltage. To overcome the 0.6 Volt threshold of a silicon diode, an operational amplifier IC 1.1. is used with the diodes D1 and D2 in the feedback loop. The threshold voltage of the diode D1 is thus divided by the amplifier's open loop gain. With the threshold virtually eliminated, it is possible to rectify millivolt signals. When the input voltage is negative, D1 is forward biased and an output signal is developed across R3. As with any inverting amplifier, the voltage gain is R3/R1. When the input signal is positive D1 is non-conducting and there is no output. However a negative feedback path is provided with diode D2, reducing the amplifier's negative output swing to −0.7 Volt and preventing the amplifier from saturating.

The pulsating DC voltage now obtained is smoothed by R4 and C3.

Amplifier IC 1.2 operates to condition the signal according to the following relationship:

$$\text{Cos } 0° \text{ to Cos } 90° \triangleq 10.0 \text{ to } 0.0 \text{ Volts.}$$

P1 and P2 act respectively as a zero and a gain or span setting; C4 and C5 smoothing any ripple.

The resulting cosine function is now to be multiplied by a factor representing the ladder length. This is a DC voltage with a ratio of 100 mV ≙ 3 feet length. As mentioned before IC 1.3 acts as a voltage follower and the multiplying circuit IC 2 is a conventional hybrid circuit with an output equal to the product XY/10. For example, let L be 90 feet ≙ 3,000 mV and let $\beta$ be 30°, so $\cos\cdot\beta=0.866 \triangleq 8.66$ Volts. The multiplier's output is then 2,598 mV, representing the contribution of the ladder to the ship's length: 77'11".

As follows from the formula mentioned before, the pontoon length P and the spud carrier position p are now to be added to the product L $\cos\cdot\beta$. This is done with the non-inverting adding circuit around IC 1.4. P and p (ratio 100 millivolt ≙ 3 feet) are fed to the terminals N and P while terminal R is grounded. The voltage at the non-inverting input of the IC 1.4 equals $\frac{1}{4}(P+p+L\cdot\cos\cdot\beta)$, so for a gain of unity (R16+R16A+P6)/R11 must be a factor 3. P4 and P6 are zero and span settings respectively, while C6 and C11 provide some smoothing.

At this point it will be understood that the enlargement p caused by the spud-carrier may also be caused by a tilting spud if the pontoon is provided with such a type of spud to advance the pontoon along the channel.

The signalling unit 16 permits separate settings for PS and SB warnings and is also fed with an output of the phase-detection unit 14 to detect whether the cutterhead is PS or SB relative to the centreline. This is necessary to inhibit PS warnings when the cutterhead is on SB relative to the centreline, and vice versa.

Figure 5:
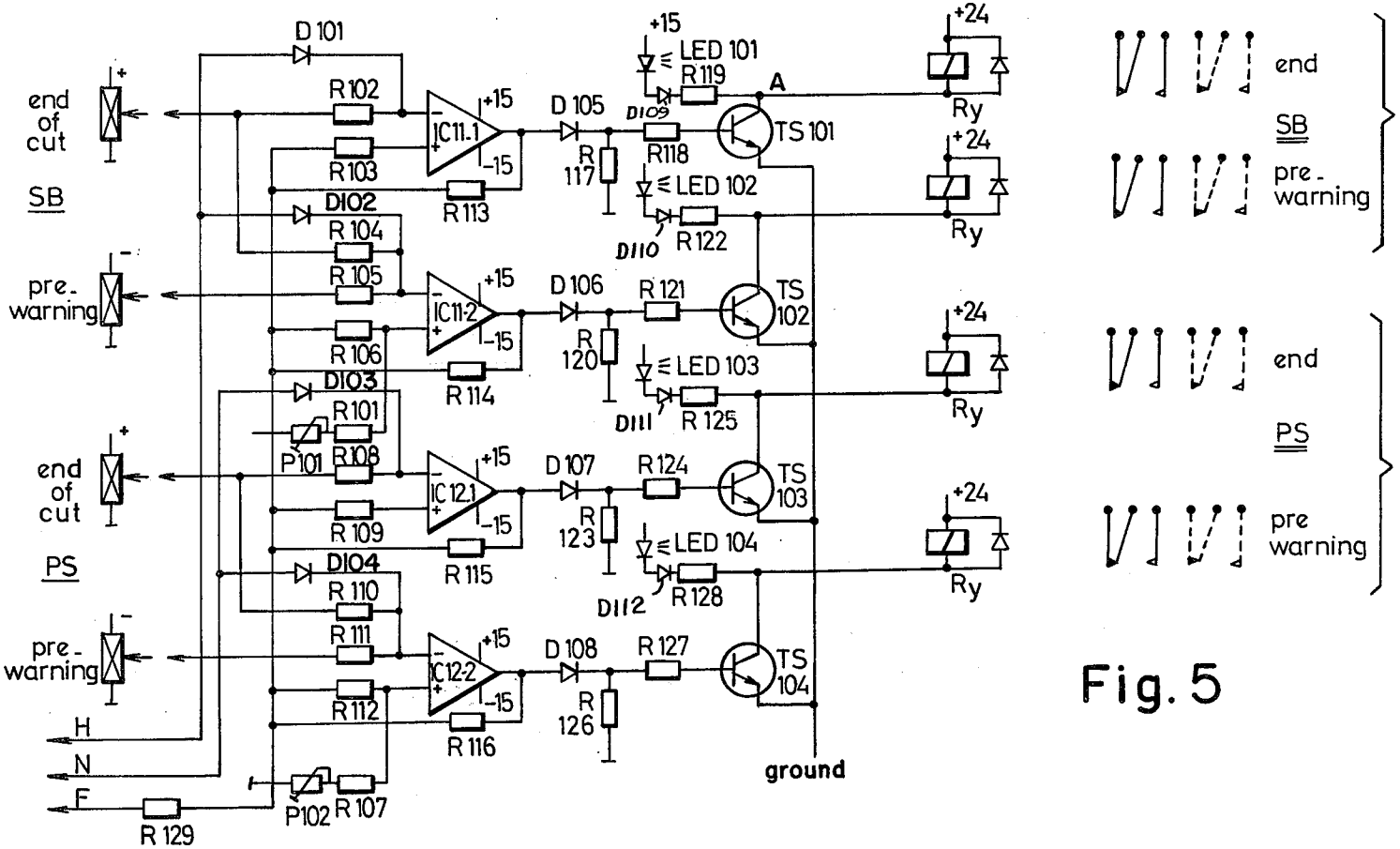
FIG. 5 is a detailed circuit diagram of a signalling circuit, which is adapted to give relay actions on certain pre-settable widths.

The signalling unit 16 is illustrated in more detail in FIG. 5. This signalling circuit is meant to give relay actions on certain presettable widths. The circuit mainly consists of two pairs of analog comparators: one set IC 11.1 and IC 11.2 for working on the SB side of the centreline, the other set IC 12.1 and IC 12.2 for working on the port side. Each pair has two switch points: one warning "END of cut" and one "PREWARNING". The side winches may be controlled by the corresponding relays $R_y$, e.g. passing of the prewarning may cause the winch to slow down to half speed; and passing of the end-of-cut warning may cause the winch to be stopped.

The non-inverting inputs of the prewarning amplifiers IC 11.2 and IC 12.2 are connected to ground via a series circuit of a resistor R101 with a potentiometer P 101 and a resistor R107 with a potentiometer P102 respectively, and the non-inverting inputs of all amplifiers are connected together via resistors R103, R106, R109 and R112, and the junction point of these resistors is in turn connected to a terminal F via a resistor R129. To this terminal the width output signal from the adder 13 is fed. To the junction point of the resistors R103, R106, R109 and R112 also are connected the feedback loops of the operational amplifiers, which feedback loops contain the resistors R113, R114, R115 and R116 respectively.

The inverting inputs of the operationals amplifiers are connected to the four switch point pre-set means via the resistors R102, R105, R108 and R111 respectively, and the inverting inputs of both the pre-warning amplifiers are also connected to the end-of-cut pre-set means via the resistors R104 and R110 respectively. The four switch point pre-set means are formed as 10-turn potentiometers on the computer's front panel. The inverting inputs of the first pair of operational amplifiers are furthermore connected together by means of the diodes D101 and D102 respectively, and the junction point is further connected to the terminal H of the phase detection circuit, on which +15 Volts is applied when cutting on port side of the centreline. The inverting inputs of the second pair of operational amplifiers are connected together via diodes D103 and D104 respectively, the junction point of which is connected to the terminal N of the phase detection circuit, on which +15 Volts is applied when cuttering on SB side.

The output of the operational amplifier IC 11.1 is connected to the base of transistor TS101 via a diode D105 and a resistor R118, the junction point of which is connected to ground via a resistor R117. In a similar way the output of IC 11.2 is connected with the base of a transistor TS102 via a diode D106 and a resistor R121, the junction point of which is connected to ground via a resistor R120; the output of IC 12.1 is connected to the base of the transistor TS103 via a diode D107 and a resistor R124, the junction point of which is connected to ground via a resistor R123; and the output of IC 12.2 is connected to the base of the transistors TS 104 via a diode D108 and a resistor R127, the junction point of which is connected to ground via a resistor R126.

The emitters of the transistors TS101 through TS 104 are connected with a point of zero potential. In the collector circuit of each transistor is a LED 101, 102, 103 and 104 respectively in series with a diode D109 and a resistor R119, D110 and a resistor R122, D111 and a resistor R125, and D112 and a resistor R128 respectively; and parallel to these collector circuits are furthermore the relays $R_y$.

The signalling circuit operates as follows. When cutting on port side of the centreline terminal H is +15 Volts, thus forcing the outputs of IC 11.1 and IC 11.2 to −15 Volts. When cutting on SB side terminal N is +15 Volts so now the outputs of IC 12.1 and IC 12.2 are forced low. In this way only the warnings on the working side are enabled.

For a description of the SB-pair of comparators, let us assume warnings at 35 and 40 yards width. The end warning potentiometer is set to 40 yards ≙ 4.000 Volts, and the prewarning is set to (40−35) ≙ −0.500 Volts, that is the warning set is the difference between end warning and pre-warning. The output of IC 11.1 will be negative until the width signal at terminal F reaches 4.000 Volts ≙ 40 yards. Then the output of IC 11.1 goes high and the output terminal A of the transistor TS 101 goes low, so the respective relay $R_y$ is energized. The output of IC 11.2 however goes positive when the signal at terminal F reaches 3.500 Volts ≙ 35 yards, because the voltage at its inverting input is 1.750 Volts, and the voltage at its non-inverting input is half the voltage at terminal F. Note that the prewarning setting is a negative voltage.

The PS circuit is of course identical. Potentiometers P101 and P102 cancel the effect of resistor tolerances. The resistors R113 through R116 create a certain hysteresis. LED's 101 through 104 facilitate calibration and checking of the circuit.

It will be apparent, that the invention is susceptible of changes and modifications without, however, departing from the scope and spirit of the appendent claims.

What is claimed is:

1. A dredge profile computer for a cutter suction dredge consisting of a pontoon, a pivotally mounted ladder on said pontoon and provided with a head, and two spuds, one of which may be movable in the axial direction of the pontoon, said computer comprises a pontoon course data pick-up means, ladder angle transmitting means, a spud position transmitting means and means to introduce corrections relative to the draught of the pontoon in the computer, a plurality of data converting means, multiplier means and adder means to calculate from the swing angle and elevation angle of the ladder sine and cosine functions and in combination with transmitted or preset values for the ladder length, the pontoon length, the spud position and draught corrections the coordinates for the depth and the width of the cutterhead; and furthermore means to indicate the depth and width of the cutterhead, and in combination with said indicator means warning means for warning a dredge operator when approaching and/or exceeding predetermined width limits of the cutterhead; and an adjustment and control unit for presetting the end of sweep of the cutterhead at port side and star board; for pre-warning of the end of cut at port side and starboard, and for presetting draught and course adjustments.

2. A dredge profile computer for a cutter suction dredge according to claim 1 in which said pontoon course data pick-up means, ladder angle transmitting means and data converting means comprise a gyro-compass synchro-linked with a repeater compass and a first resolver friction coupled to the repeater, and a rectifyinsg means connected with the output of said resolver, so that the output thereof is proportional to the sine of the swing-angle ($\alpha$) of the pontoon; and furthermore a pendulous mass mounted on the cutterladder, and a second resolver connected to said pendulous mass and having two outputs connected to second and third modifying means respectively so that the outputs of said rectifying means are proportional to the sine and cosine respectively of the ladder elevation angle ($\beta$); said multiplier means in the computer consisting of first, second and third multipliers each connected to the output of the first, second and third rectifying means respectively, the second and third multipliers each having as a second input the ladder length (L); and said adder means in the computer consisting of first, second and third adders respectively, the second adder having as second and third inputs the pontoon length (P) and the position of the movable spud (p), and having its output connected with a second input of the first multiplier, the first and third adders having as second input the cutterhead radius ($R_c$) so, that the output of the first adder represents the width-coordinate of the cutterhead:

$$\text{WIDTH}=(P+p+L\cdot\cos\beta)\sin\alpha+R_c$$

the third adder having as third and fourth inputs respectively the correction ($T_1$) of the depth of the trunnion of the ladder, which trunnion pivotally connects the ladder with the pontoon, and the correction ($T_2$) for the tidal difference of the height of the pontoon so, that the output of the third added represents the depth-coordinate of the cutterhead:

$$\text{DEPTH}=L\cdot\sin\beta+R_c+T_1+T_2.$$

3. A dredge profile computer for a cutter suction dredge consisting of a pontoon, a pivotally mounted ladder on said pontoon and provided with a head, and two spuds, one of which may be movable in the axial direction of the pontoon, said computer comprises a gyro-compass synchro-linked with a repeater compass and a first resolver friction coupled to the repeater; A.C. generator means having a first output connected to said resolver and phase detector means having a first input connected to said generator means and a second input connected to the output of the resolver, the outputs of said phase detector means serving as inputs for an alignment indicator and port side, centre and starboard indicating means.

4. A dredge profile computer for a cutter suction dredge according to claim 3 and adapted to compute at least the width coordinate of the ladder, which computer furthermore comprises a signalling unit having as inputs said width coordinate, an output of the phase detector means representing port side or starboard of the ladder, and presetting for the ends of width themselves and for a prewarning of the ends of the width; and portside and starboard signalling indicators and prewarning indicators connected with the outputs of said signalling unit.

5. A dredge profile computer for a cutter suction dredge according to claim 4, said signalling unit comprises two pairs of two operational amplifiers one starboard pair and another port side pair, each amplifier being provided with a resistor feedback circuit, the inverting inputs of the amplifier of each pair connected via diodes with the starboard and port side output respectively of the phase detector, the first amplifier means of each pair having their inverting inputs connected also via resistors to preset end of width signal sources respectively, and the second amplifier means of each having their inverting inputs connected also via resistors to preset prewarning end of width signal sources respectively, all the operational amplifiers having their non-inverting inputs connected via resistors to the actual width output of the computer adapted to compute at least the width coordinate of the ladder head; said unit comprises furthermore four transistors having their bases connected to the outputs respectively of the operational amplifiers via a dividing resistor-network and a diode, and having their collectors connected to relays to effect different signalling and controlling functions.

6. A dredge profile computer for a cutter suction dredge consisting of a pontoon, a pivotally mounted ladder on said pontoon and provided with a head, and two spuds, one of which may be movable in the axial direction of the pontoon, said computer being adapted to compute the depth and width coordinates of the ladder and comprising at least pontoon swing and ladder elevation angle transmitting means mechanically or electrically linked with a resolver, and a generator means feeding a triangular A.C. signal to said resolver, rectifying means, multiplying means and adder means; said rectifying means consist of a first operational amplifier with two oppositely connected diodes between the output and the inverting input of said amplifier and a resistor series connected in circuit with one of said diodes, the non-inverting input of the operational amplifier being grounded via a resistor; and furthermore of a second operational amplifier the non-inverting input of which connects to the output of said first operational amplifier via a smoothing network, and provided with an adjustable RC-feedback circuit adjusted in such a way, that the value 1 of the sine or cosine function issued from the resolver corresponds to a fixed normal voltage at the output of said second amplifier; said multiplier means consists of an integrated circuit, having one of the inputs connected to the output of the rectifying means and another input connected to a data signal source via a third operational amplifier serving as a voltage follower; and said adder means consists of a fourth operational amplifier provided with an adjustable RC-feedback circuit, connected between the output and the inverting input, to which an adjustable bias voltage is applied, and having the non-inverted input thereof connected to the output of the multiplier means via a resistor, and connected also to further data signal sources via other resistors, which data are added to the output value of the multiplier in said adder means.

* * * * *